United States Patent [19]

Eisenbeis et al.

[11] Patent Number: 4,693,517

[45] Date of Patent: Sep. 15, 1987

[54] CUTTER FOR GOUGING ORE OR ROCK FROM MINE FACES

[75] Inventors: Martin Eisenbeis, Neunkirchen; Walter Hemmer, Wiebelskirchen; Hans Krummenauer, Spiesen, all of Fed. Rep. of Germany

[73] Assignee: Hans Krummenauer GmbH & Co. KG, Neunkirchen, Fed. Rep. of Germany

[21] Appl. No.: 838,527

[22] Filed: Mar. 11, 1986

[30] Foreign Application Priority Data

Mar. 13, 1985 [DE] Fed. Rep. of Germany ..... 3508881

[51] Int. Cl.[4] ..... E21B 10/00

[52] U.S. Cl. ..... 299/87; 299/90

[58] Field of Search ..... 299/87, 90, 45, 46, 299/56, 68

[56] References Cited

U.S. PATENT DOCUMENTS

| | | | |
|---|---|---|---|
| 1,488,766 | 4/1924 | Quist | 299/46 |
| 1,586,151 | 5/1926 | Hess | 299/87 |

FOREIGN PATENT DOCUMENTS

| | | | |
|---|---|---|---|
| 2936184 | 3/1981 | Fed. Rep. of Germany | 299/87 |
| 745680 | 2/1956 | United Kingdom | 299/87 |
| 2027773 | 2/1980 | United Kingdom | 299/87 |

*Primary Examiner*—Stephen J. Novosad
*Assistant Examiner*—Bruce M. Kisliuk
*Attorney, Agent, or Firm*—Peter K. Kontler

[57] ABSTRACT

A rotary cutter for gouging out coal or rock from mine faces has a frustoconical wall whose periphery is provided with alternating helical threads and grooves. The threads carry bits which penetrate into the material of a mine face in response to rotation and simultaneous forward movement of the support whereby the removed fragments enter and flow in the adjacent grooves toward the rear end of the cutter. The flow of such fragments in the grooves is promoted by configurating the support and its threads in such a way that the grooves are bounded by surfaces having a substantially U-shaped outline without any dead corners which would allow for or cause the accumulation and stagnation of fragments of removed material.

8 Claims, 4 Drawing Figures

CUTTER FOR GOUGING ORE OR ROCK FROM MINE FACES

BACKGROUND OF THE INVENTION

The invention relates to improvements in cutters (also called cutter heads) for gouging ore or rock from mine faces in underground excavations, strip mines, quarries and similar plants. Such cutters can be used in longwall shearing and heading machines to remove coal or rock in mines, in excavations for laying the foundations of buildings and for many other purposes.

It is known to provide a rotary cutter with a support which carries several helically arranged sets of bits serving to penetrate into a rock or ore while the support is caused to rotate and move axially forwardly. The removed material is caused to enter helical grooves, which alternate with the sets of bits, and to flow rearwardly, i.e., counter to the direction of penetration of the cutter into a vein of ore or the like. As a rule, the bits are mounted on helical ribs or threads which are welded to or integral with the peripheral surface of a cylindrical or frustoconical support. Reference may be had to commonly owned German Offenlegungsschrift No. 26 53 706 and to commonly owned U.S. Pat. No. 4,244,626.

The rate at which broken pieces of ore or rock advance in the helical grooves is of great importance because this determines the output of the cutter. The aforementioned prior publications disclose helical grooves each of which is bounded by a cylindrical or frustoconical bottom surface and by two spiral surfaces extending radially of the support. This entails the formation of corners wherein the particles are likely to gather and to stagnate rather than sliding rearwardly counter to the direction of axial movement of the cutter.

OBJECTS AND SUMMARY OF THE INVENTION

An object of the invention is to provide a novel and improved cutter which is constructed and assembled in such a way that it promotes the flow of fragments of ore, rock or like material counter to the direction of its penetration into a mine face or the like.

Another object of the invention is to provide a cutter which prevents the accumulation of stagnant pieces of ore or rock in the grooves between the helical arrays of bits at the periphery of the support.

A further object of the invention is to provide a cutter which can be used in presently known machines as a superior substitute for conventional cutters.

An additional object of the invention is to provide a cutter wherein the exterior of the support for the bits is configurated in a novel and improved way to promote the flow of fragments of ore, rock or the like away from the locus of removal of material from the mine face.

Still another object of the invention is to provide a novel and improved method of promoting the evacuation of broken pieces of ore, rock and the like from the location where such material is removed in a strip mine, in a quarry or in an underground excavation.

Another object of the invention is to provide a novel and improved support for use in the above outlined cutter.

The invention resides in the provision of a rotary cutter for gouging out ore or rock from mine faces or the like. The cutter comprises a rotary support which is designed to penetrate axially into the mass of material to be comminuted and comprises helical external threads or ribs alternating with helical grooves, and a plurality of bits which are provided on the threads to remove fragments from a mass of ore or rock into which the bits penetrate while the support is caused to move forwardly whereby the removed fragments enter into and are caused to flow in the grooves in the axial direction of axial movement of the support. In accordance with a feature of the invention, the surfaces which surround the grooves include portions having a concave outline to promote the flow of fragments in the axial direction of the support. The concave portions of surfaces bounding the grooves are provided in the regions where the conventional supports exhibit sharply defined corners which are likely to gather and retain fragments of ore or rock so that the resulting accumulations of fragments remain in the grooves to thus reduce the rate at which the fragments can be evacuated from the locale of material removal, not only due to accumulation of fragments in the grooves but also because such accumulations oppose the flow of other fragments in the respective grooves.

Each surface can include a first or front portion (nearer to the front end of the support) which has a substantially semielliptical outline and a second or rear portion having a substantially semicircular outline.

Each thread on the support can include an overhung portion which is adjacent to one of the neighboring grooves and along which the removed fragmentized material slides on its way away from the locus of penetration of bits into a mine face or the like. Each bit can comprise a tool holder which is mounted on the respective thread, and the overhung portions of the threads can be constituted by elongated helical strips which are adjacent to the respective tool holders.

The support can include a substantially frustoconical wall which is surrounded by the helical threads. The wall has a larger-diameter front end and a smaller diameter rear end, and the depth of the grooves and threads (as measured radially of the support) preferably increases in a direction from the front toward the rear end of the wall.

Each of the aforementioned surfaces can include at least one portion which is adjacent to the respective bits and extends substantially radially of the support, i.e., such surface portion need not have a concave shape. In many instances, the support is formed with surfaces which have a substantially U-shaped outline, i.e., with two flat sections in the regions of the adjacent series of bits and a concave section disposed in the deepmost portion of the respective groove and merging gradually into the corresponding flat sections.

The novel features which are considered as characteristic of the invention are set forth in particular in the appended claims. The improved cutter itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
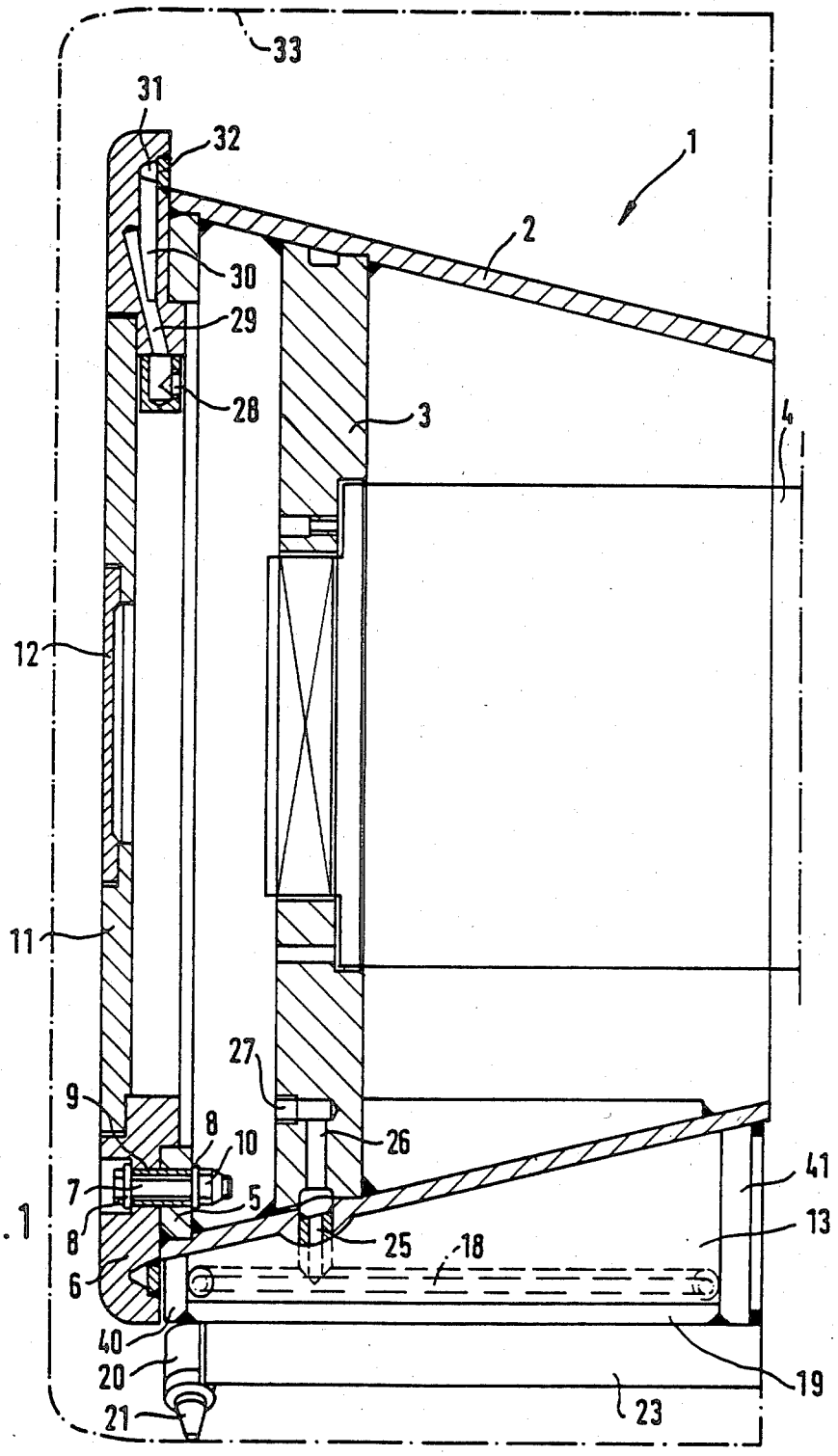
FIG. 1 is fragmentary axial sectional view of a rotary cutter which embodies the present invention.
Figure 2:
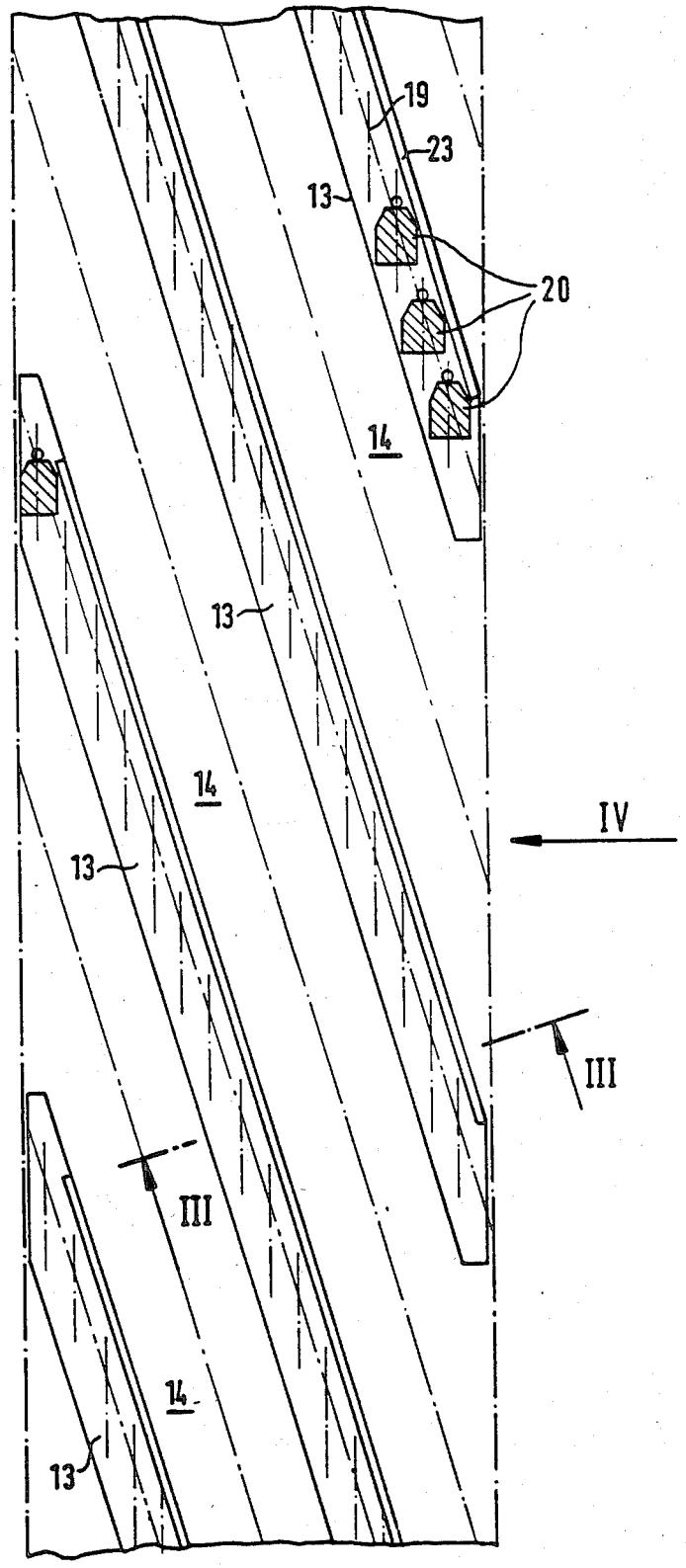
FIG. 2 is a fragmentary developed view of the threads and grooves at the periphery of the frustoconical wall of the cutter which is shown in FIG. 1.

The rotary cutter 1 which is shown in FIGS. 1 to 4 comprises a support having a hollow frustoconical wall 2 which tapers counter to the direction of forward movement of the cutter into a mine face or the like, i.e., the larger-diameter end of the wall 2 is nearer to the front end of the cutter. The support further comprises a sturdy disc 3 which is inserted into and is welded to the wall 2. The central portion of the disc 3 is connected with a shaft 4 which serves to rotate the cutter 1 and to drive it forwardly whereby the tools 21 of several sets of material removing bits penetrate into the mine face and comminute the material at a rate which is determined by the ability of the cutter to remove the fragments in a direction counter to the direction of penetration of the cutter into the mine face. The larger-diameter front end of the wall 2 is welded to a ring 5 which is separably connected with an annular cap 6. The means for connecting the cap 6 to the ring 5 comprises several bolts 7 (only one can be seen in FIG. 1) having externally threaded shanks extending through sleeves 9 and carrying pairs of washers 8. The heads of the bolts 7 are outwardly adjacent to the cap 6 and the rear ends of the bolts mate with nuts 10. The annular cap 6 surrounds a disc-shaped closure 11 with a centrally located opening normally closed by a disc-shaped lid 12.

The support including the wall 2 and the disc 3 further comprises a set of four helical threads or ribs 13 which are disposed at the exterior of the wall 2 and whose depth (as measured radially of the wall 2) increases gradually in a direction from the front end toward the rear end of the support. This also applies for the helical grooves 14 which alternate with the threads 13. The width of the grooves 14 (as measured in the circumferential direction of the support including the wall 2) can exceed the width of the threads 13 (see FIG. 4). The shallowest portion of a groove 14 is denoted in FIG. 3 by a phantom line 15, and the groove portion of medium depth is denoted by a phantom line 16. The deepest portion of the median groove 14 of FIG. 3 (at or close to the rear end of the wall 2) is denoted by a solid line.

Figure 3:
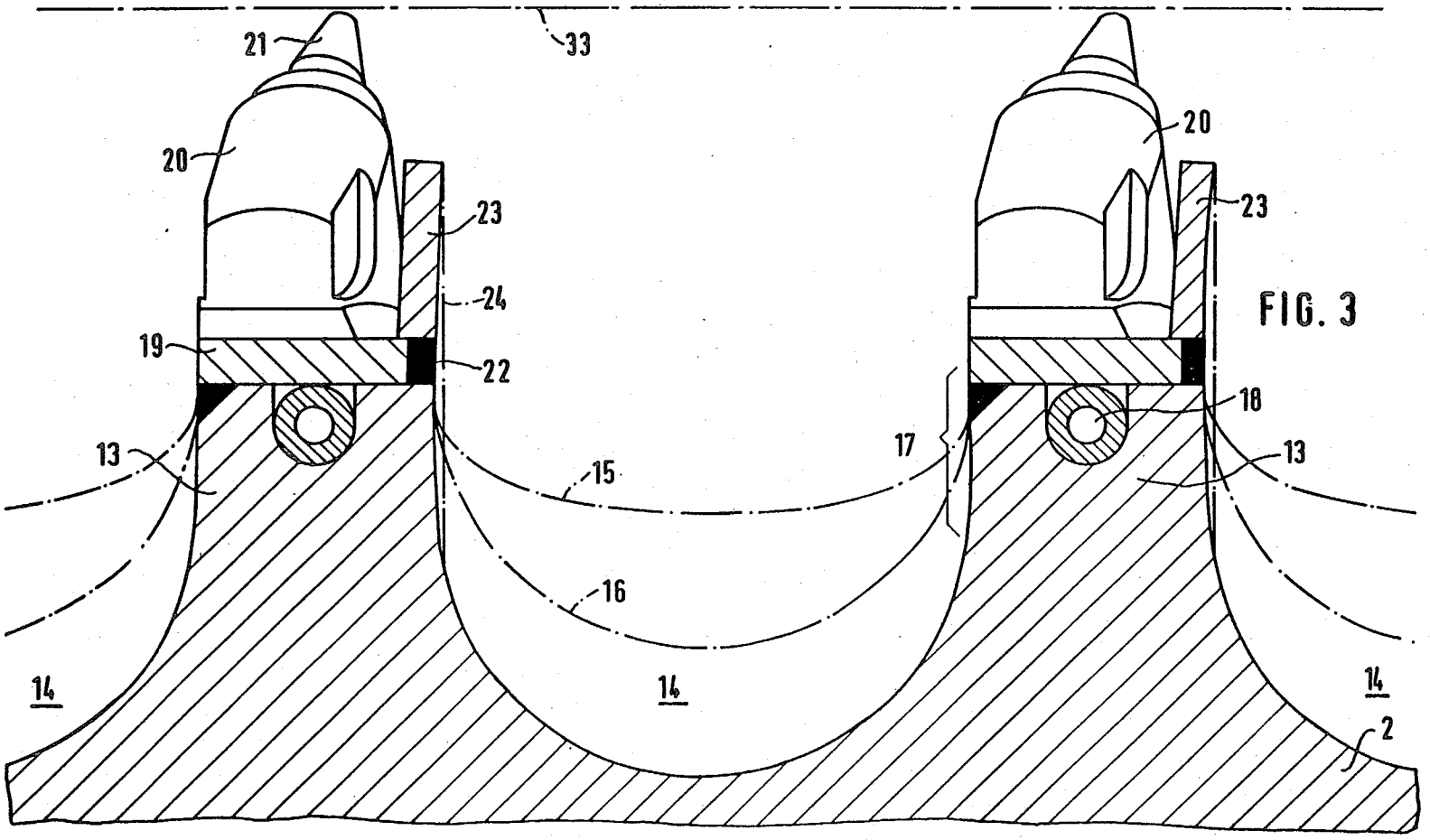
FIG. 3 is an enlarged fragmentary sectional view as seen in the direction of arrows from the line III—III of FIG. 2.
Figure 4:
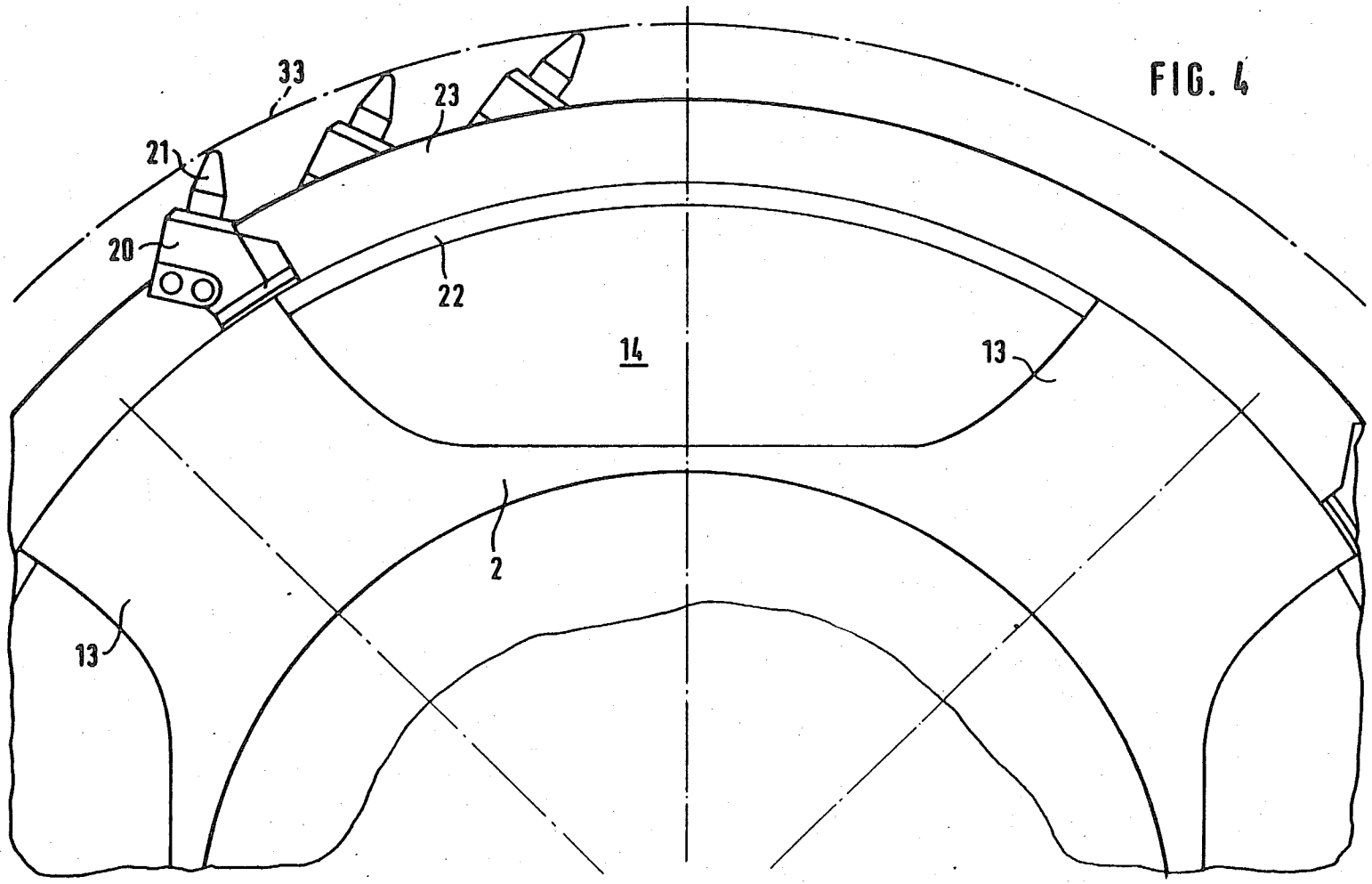
FIG. 4 is an enlarged fragmentary rear elevational view of the cutter as seen in the direction of arrow IV in FIG. 2.

In accordance with a feature of the invention, at least a portion of the surface bounding a groove 14 has a concave outline so as to avoid the formation of pronounced corners which could gather and retain fragments of ore or rock to thus reduce the output of the cutter 1. The front portion of each groove 14 can be bounded by a surface portion having a substantially semielliptical outline, and the median portion of each groove 14 can be bounded by a surface portion having a substantially semicircular outline (this is indicated in FIG. 3 by the phantom lines 15 and 16). The deepmost portion of each groove 14 can be bounded by a surface portion having a substantially semicircular outline and by two substantially flat surface portions or sections 17 which merge gradually into the respective semicircular surface portion. In all instances, the grooves can be bounded (either entirely or in part) by surfaces having a substantially U-shaped outline whereby the legs of the U are shorter at the front end and longer at the rear end of the wall 2.

The threads 13 contain water-conveying conduits 18 which are overlapped by plates 19 serving to carry the holders 20 of the bits. The holders 20 contain the material-removing tools 21. Each plate 19 is welded to the main portion of the respective thread 13, and each such thread preferably further carries a strip-shaped portion 23 which is welded to the respective plate 19 and to the main portion of the respective thread 13, as at 22. The strip-shaped portions 23 are slightly overhung (as indicated by the phantom line 24 of FIG. 3) in the regions where streams of fragmentized ore or rock slide along the corresponding threads toward the rear end of the wall 2. The plates 19 and the strips 23 can be welded to the main portions of the respective threads 13 in a single operation.

Each conduit 18 delivers a stream of pressurized water to the set of bits on the respective thread 13. As shown in FIG. 1, the conduits 18 are in communication with a conduit 25 and with an arcuate channel 26 in the disc 3. The channel 26 communicates with a port 27 which is connected with a flexible water supplying conduit (not shown). The flexible conduit can receive pressurized liquid from a suitable source by way of a passage in the shaft 4.

The cap 6 is provided with channels 29 and 30 communicating with a port 28 which receives pressurized water from the aforementioned source (preferably through a passage in the shaft 4) and supplies water to nozzles which are adjacent to additional bits on the cap 6. Such nozzles receive water from an annular channel 31 which is machined into the cap 6 and communicates with the channels 30. Those portions of the channel 31 which extend between neighboring nozzles on the cap 6 are sealed, as at 32.

The wall 2 and its threads 13 preferably constitute a one-piece casting. The axial ends of the threads 13 are shielded by wearing plates 40 and 41.

The phantom line 33 denotes in FIG. 1 an imaginary envelope which is described by the tips of the tools 21 forming part of bits on the cap 6 and on the threads 13 of the wall 2.

When the cutter 1 is put to use, e.g., in a coal mine, it is caused to form a slit in the vein of coal in a strip mine or in an underground excavation. The removed fragments are caused to flow in the orbiting grooves 14 whereby the overhung portions of the threads 13 act not unlike pushers and compel the fragments to travel in a direction from the front plate 40 toward and beyond the rear plate 41. The fragments are caused to slide in the respective grooves 14 by gravity flow and/or exclusively under the action of orbiting threads 13, depending on the orientation of the cutter.

It has been found that the elimination of pronounced corners in the grooves 14 enhances the flow of fragments away from the location where the bits penetrate into the mine face so that the output of the improved cutter can be increased accordingly. The flow of fragments is enhanced in spite of the fact that the width of surface sections 17 (measured radially of the wall 2) is only a fraction of the width of flat (non-concave) surface sections on the threads of conventional cutters. The reason is that the elimination of corners reduces the likelihood of gathering of fragments in the grooves 14 so that each groove allows for the flow of large streams of fragmentized material.

A fragment which lies against a flat surface in a helical groove is likely to remain there because it is not compelled to move transversely of and away from the respective thread. On the other hand, a fragment in one of the grooves 14 is urged to move toward the center of such groove and to be entrained by the bulk of fragments advancing toward the rear end of the wall 2. Moreover, a fragment in the deepmost portion of a groove 14 is caused to slide radially outwardly along the concave portion of the respective surface and to thus enter the path of advancing fragments which cause it to travel toward the rear end of the cutter. The tendency of fragments to slide radially outwardly is particularly pronounced in those portions of the grooves 14 which are bounded by substantially semielliptical and substantially semicircular surface portions (as indicated at 15 and 16 in FIG. 3 of the drawing). Such surface portions cause entire groups or batches of fragments to slide radially outwardly so that they are unlikely to stagnate in the deepmost portions of the respective grooves. The thus shifted fragments or accumulations of fragments penetrate into the less dense portions, gaps or cavities of the stream of fragments flowing in the respective groove. Moreover, such migration of fragments in and from the deepmost portions of the grooves 14 causes relative movement of fragments in the adjacent portions of the grooves so that the fragments of streams in the grooves are caused to move in a direction from the front toward the rear end of the wall 2 as well as in several other directions to thereby further reduce the likelihood of accumulation of stagnant particles. Such loosening of streams in the grooves 14 has been found to enhance the predictability of evacuation of fragments from the bits toward the rear end of the cutter by reducing the likelihood of bridging, jamming and other undesirable formations. Bridges of jammed particles are likely to accumulate in the grooves of conventional cutters wherein the depth of each groove is substantially constant all the way from the radially outermost to the radially innermost portions of the neighboring threads.

It has been found that the improved cutter ensures predictable evacuation of fragmentized material not only in the upper halves of the orbiting grooves 14 (when the shaft 4 is horizontal or nearly horizontal) but also in the lower halves of such grooves, especially if each portion of a groove is at least substantially filled with fragmentized coal or the like. As a rule, the grooves 14 are filled with comminuted material.

The provision of overhanging thread portions 23 enhances the so-called shovel effect or scooping action of the threads 13, especially in the lower half of the cutter. Moreover, such overhang compensates in part for the presence of relatively short surface portions (17) which extend radially or nearly radially of the support 2. It can be said that the strips 23 increase the depth of the threads in the radial direction of the wall 2 and thus enable the threads to more effectively push the adjacent fragments toward the rear end of the wall 2 when the shaft 4 is driven to rotate the cutter. The strips 23 are made of a highly wear-resistant material and can be removed after extensive wear so that the cutter need not be discarded merely because the thickness of the strips 23 has been reduced below an acceptable value.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A cutter for gouging out ore or rock, comprising a hollow rotary support arranged to penetrate into a mine face or the like and comprising a wall with helical external threads and helical grooves alternating with said threads and being devoid of dead corners wherein the fragments could accumulate and stagnate; and a plurality of bits provided on said threads to remove frgments from the ore or rock into which the bits penetrate in response to rotation of the support whereby the removed fragments enter into and flow in the grooves in the axial direction of the support, said support having bottom surfaces which bound said grooves and at least a portion of each such surface having a concave outline to thus promote the flow of fragments in the respective grooves.

2. The cutter of claim 1, wherein each of said surfaces includes a first portion having a substantially semielliptical outline and a second portion having a substantially semicircular outline.

3. The cutter of claim 2, wherein said first portions are spaced apart from the respective second portions as considered in the axial direction of the support.

4. The cutter of claim 1, wherein each of said threads includes an overhung portion which is adjacent to one of the neighboring grooves and along which the fragments slide in the respective groove.

5. The cutter of claim 4, wherein each of said bits comprises a tool holder mounted on the respective thread, said overhung portions including strips adjacent to the respective tool holders.

6. The cutter of claim 1, wherein said support includes a substantially frustoconical wall and said threads surround said wall, said wall having a larger-diameter first end and a smaller-diameter second end, the depth of said threads and said grooves increasing radially of the wall as considered in a direction from the first toward the second end of said wall.

7. The cutter of claim 1, wherein each of said surfaces includes at least one portion which is adjacent to said bits and extends substantially radially of said support.

8. The cutter of claim 1, wherein each of said surfaces includes a portion having a substantially U-shaped outline.

* * * * *